US007100409B2

(12) United States Patent
Chang

(10) Patent No.: US 7,100,409 B2
(45) Date of Patent: Sep. 5, 2006

(54) BURGLARPROOF LOCK CORE STRUCTURE

(76) Inventor: Tsao-Chia Chang, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 11/028,189

(22) Filed: Jan. 4, 2005

(65) Prior Publication Data

US 2006/0144104 A1 Jul. 6, 2006

(51) Int. Cl.
*E05B 27/06* (2006.01)

(52) U.S. Cl. ..... 70/493; 70/358; 70/375; 70/399; 70/407; 70/409; 70/419

(58) Field of Classification Search ..... 70/375, 70/409, 396–399, 401, 419, 493, 358, 494, 70/495, 421, 402–407
See application file for complete search history.

(56) References Cited

U.S. PATENT DOCUMENTS

| | | | | | |
|---|---|---|---|---|---|
| 360,738 | A * | 4/1887 | Smith | 70/405 |
| 616,751 | A * | 12/1898 | Vedder et al | 70/493 |
| 1,977,189 | A * | 10/1934 | Larson et al. | 70/421 |
| 2,147,061 | A * | 2/1939 | Hamilton | 70/358 |
| 2,620,649 | A * | 12/1952 | Domingo | 70/358 |
| 3,393,542 | A * | 7/1968 | Alois | 70/358 |
| 3,531,959 | A * | 10/1970 | Weber | 70/493 |
| 4,111,019 | A * | 9/1978 | Rabinow | 70/358 |
| 4,703,638 | A * | 11/1987 | Bergstrom | 70/369 |
| 4,805,428 | A * | 2/1989 | Kruhn | 70/393 |
| 5,086,632 | A * | 2/1992 | Hsu | 70/375 |
| 5,131,247 | A * | 7/1992 | Hsu | 70/358 |
| 5,671,623 | A * | 9/1997 | Hsu | 70/375 |
| 6,378,345 | B1 * | 4/2002 | Lin | 70/409 |
| 6,666,057 | B1 * | 12/2003 | Huang | 70/375 |
| 6,925,844 | B1 * | 8/2005 | Liu | 70/375 |
| 2004/0060332 | A1 * | 4/2004 | Liu | 70/409 |
| 2004/0172992 | A1 * | 9/2004 | Huang | 70/358 |

* cited by examiner

*Primary Examiner*—Lloyd A. Gall
(74) *Attorney, Agent, or Firm*—Troxell Law Office, PLLC

(57) ABSTRACT

The present invention provides a burglarproof lock core structure which forms a curved passage between a key slot of a plug and a lower pin chamber, such that at least a bending concave surface offsetting the center of the key slot is formed at one side, and cone apexes of a plurality of lower pins are extended out of the lower pin chamber and aligned in the wall edge of the key slot. Moreover, a control valve with a cone apex is located at the other end corresponding to the bending surface inside the key slot, such that a key with curvature corresponding to the passage and notches corresponding to the cone apexes is required to open the lock, thereby having the effect of high security of burglarproof.

3 Claims, 6 Drawing Sheets

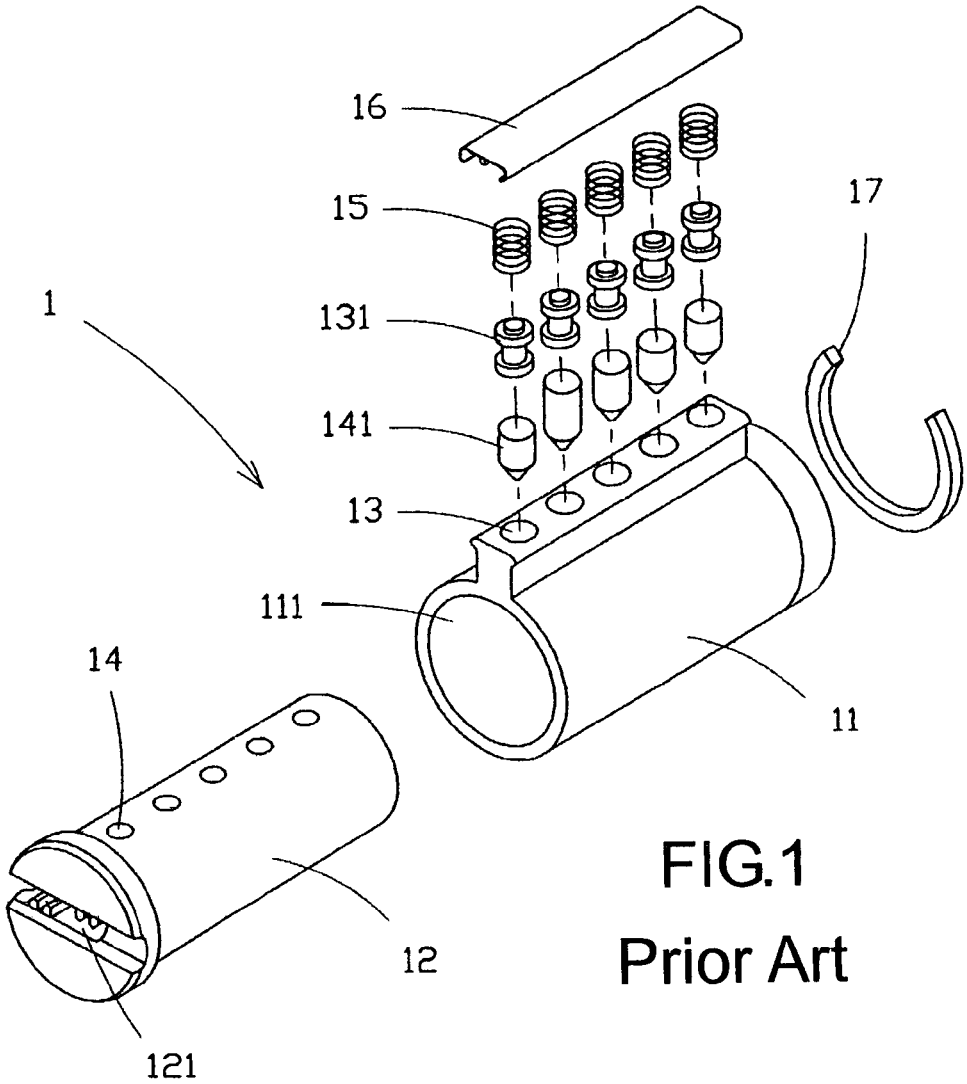
FIG.1
Prior Art
FIG. 1A
Prior Art
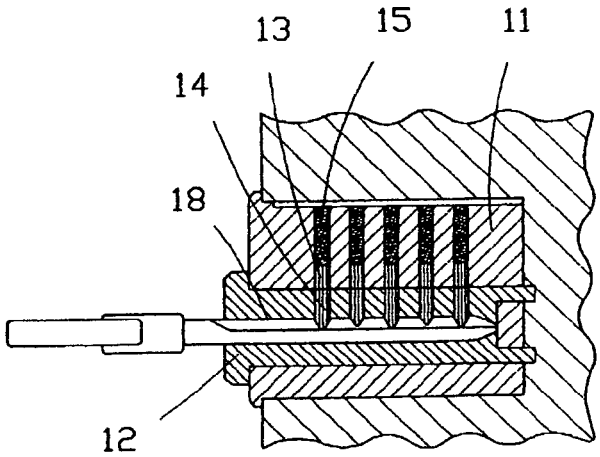

FIG.5
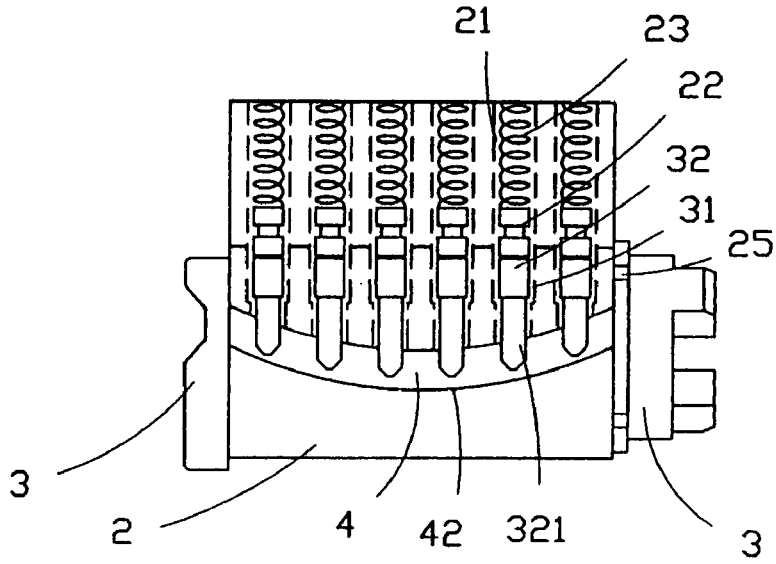
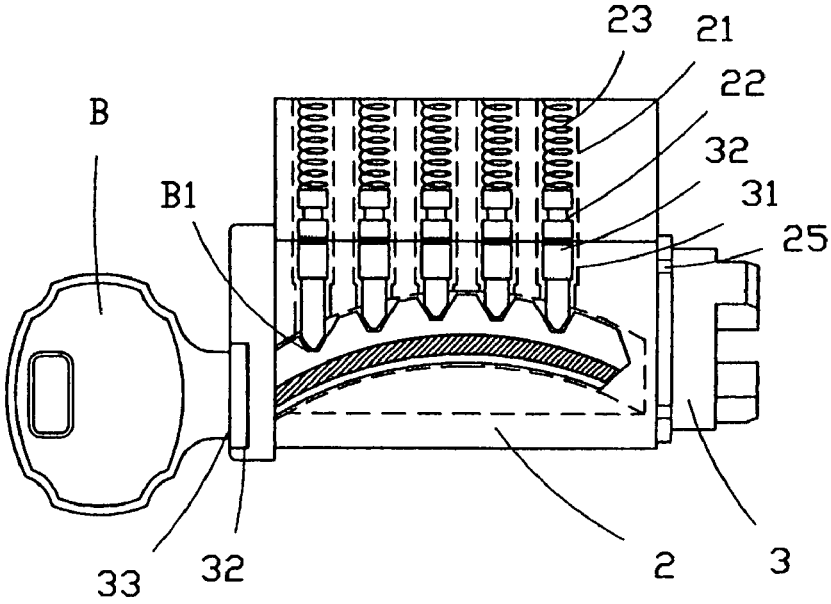
FIG.6

BURGLARPROOF LOCK CORE STRUCTURE

BACKGROUND OF THE INVENTION a) Field of the Invention

The present invention relates to a burglarproof lock core structure, and more particularly to a burglarproof lock core structure which can largely increase the difficulty of being broken through.

b) Description of the Prior Art

Referring to FIG. 1, a conventional lock core comprises primarily a shell 11 and a plug 12 inside the shell 11, wherein an upper pin chamber 13 interconnected with a lower pin chamber 14 are located between the shell 11 and the plug 12. After orderly inserting a plurality of upper pins 131, lower pins 141, and springs 15 into the upper pin chamber 13, a lid 16 is covered on top of the upper pin chamber 13. In addition, a through hole 111 is inside the shell 11, and after inserting the plug 12 into the through hole 111, a C-shaped clip is used to fix at the end. Therefore, in order to open a lock (as shown in FIG. 1A), a key that matches every lower pins 141 and can completely extend into the upper pin chamber 13 is required to pass through a passage 18 formed inside a key slot 121 of the plug 12 to form an aligned gap between the shell 11 and the plug 12.

However, as the passage 18 of the aforementioned conventional lock core is in a straight-line shape, using a straight-line object such as an iron wire can also directly pass through the passage 18 to press every upper pins 131 and easily break through the lock, thereby causing compliant by users.

Furthermore, for inventions such as Taiwan patents 307294 and 403109, only by pressing pins at one side inside a key passage after inserting a flexible key into a lock core, the lock core can be easily broken by an object such as an iron wire. Moreover, as the lock core structure has no key fixing structure, the lock core can be damaged upon using a flexible key.

SUMMARY OF THE INVENTION

The primary object of the present invention is to provide a burglarproof lock core structure in order to improve the drawback of a conventional straight-line lock core passage structure, thereby increasing the effect of burglarproof.

Accordingly, the present invention includes a passage of hyperbolic curvature between a key slot of a plug and a lower pin chamber, such that at least a bending surface offsetting the center of the key slot will be formed, and cone apexes of a plurality of lower pins will extend out of the lower pin chamber to align in wall edge of the key slot. The lengths of cone apexes are converged toward the bending surface, and a control valve with a cone apex is located at an end corresponding to the bending surface inside the key slot, such that only a key with a passage of corresponding curvature and notches of corresponding cone apexes can be used to open the lock, thereby having the effect of high security of burglarproof.

To enable a further understanding of the said objectives and the technological methods of the invention herein, the brief description of the drawings below is followed by the detailed description of the preferred embodiments.

BRIEF DESCRIPTION OF THE DRAWINGS

FIG. 1 shows a schematic view of a conventional lock core.

FIG. 1A shows a schematic view of the profile of a conventional lock core.

FIG. 5 shows a schematic view of the profile of implementation with another orientation of passage curvature (opened horizontally) of the present invention.

FIG. 6 shows a schematic view of the profile after inserting another form of an opening key (vertical direction) of the present invention.

DETAILED DESCRIPTION OF THE PREFERRED EMBODIMENTS

Figure 2:
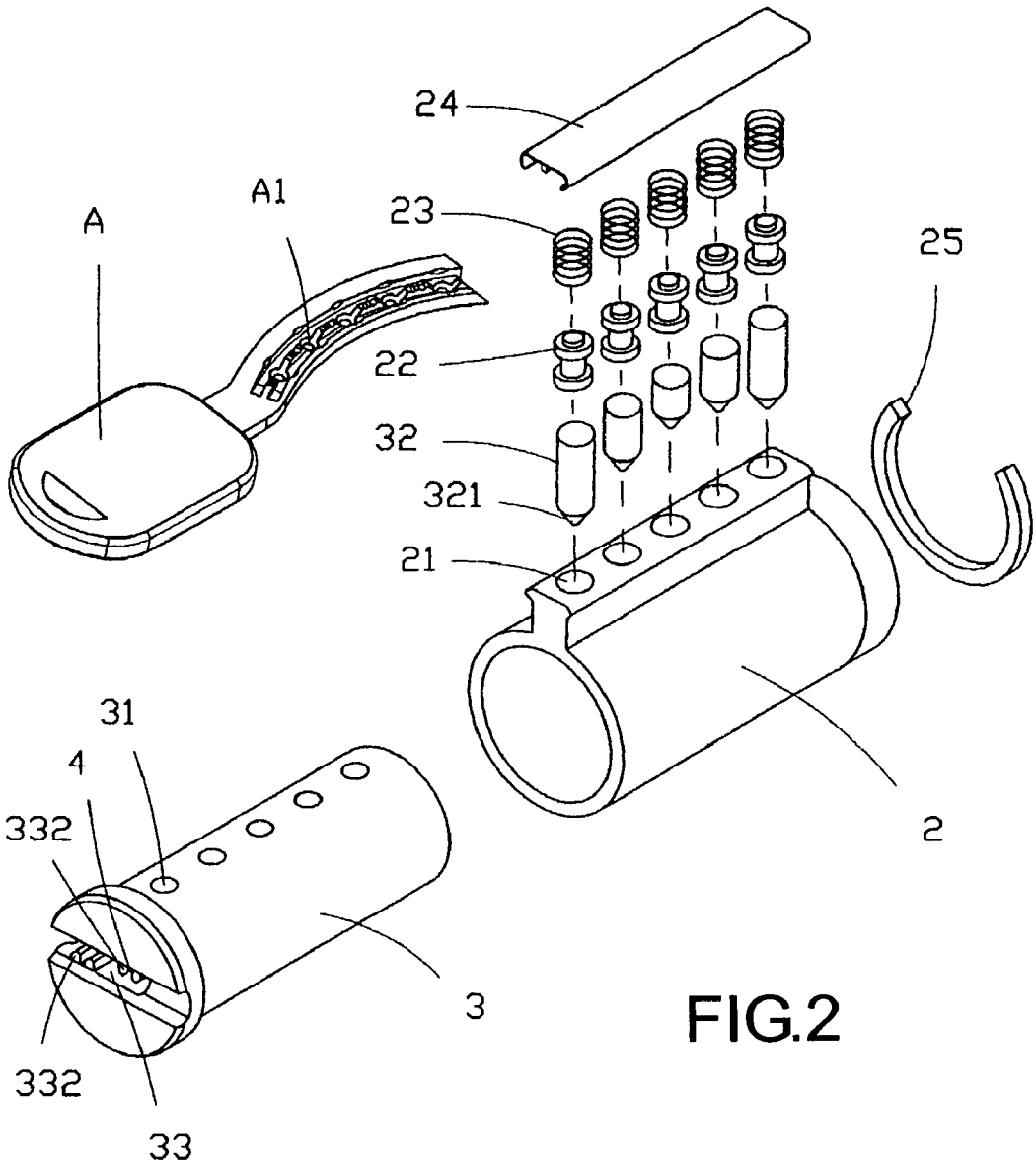
FIG. 2 shows a schematic view of the present invention.
Figure 3:
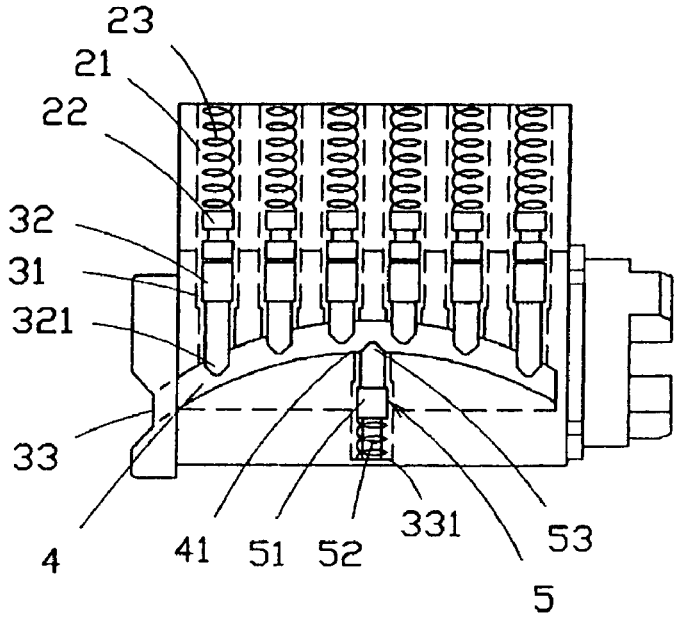
FIG. 3 shows a schematic view of the profile before inserting an opening key (horizontal direction) of the present invention.
Figure 3A:
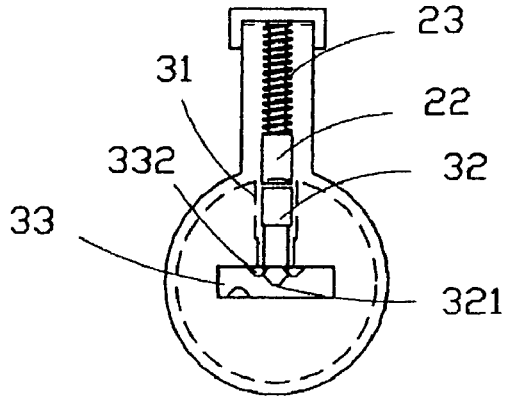
FIG. 3A shows a side view from the direction of a key slot in FIG. 3 of the present invention.

Referring to FIG. 2, the present invention provides a burglarproof lock core structure which comprises primarily a shell 2 and a plug 3 inserted into the shell 2, wherein an upper pin chamber 21 interconnected with a lower pin chamber 31 are located between the shell 2 and the plug 3, such that a plurality of lower pins 32, upper pins 22, and springs 23 can be orderly inserted into the upper pin chamber 21, and covered by a lid 24. After inserting the plug 3 into the shell 2, a C-shaped clip 25 is used to fix. A key slot 33 is located at one end of the plug 3 for inserting a key A. Referring to FIG. 3 and FIG. 3A, a curved passage 4 is formed between the key slot 33 of the plug 3 and the lower pin chamber 31, such that at least a bending concave surface 41 located at a center of the key slot 33 is formed at one side, and cone apexes 321 of the lower pins 32 are extended out of the lower pin chamber 21 and aligned in the wall edge of the key slot 33. The lengths of the lower pins 32 are gradually reduced toward a center of the concave surface 41 in an orderly fashion, and an exterior hole 331 is located at the center of the concave surface 41 inside the key slot 33 on a side opposite the lower pins 32. such that a control valve 5 with a cone apex 53 is formed by pressing a control pin 51 with a spring 52.

Figure 4:
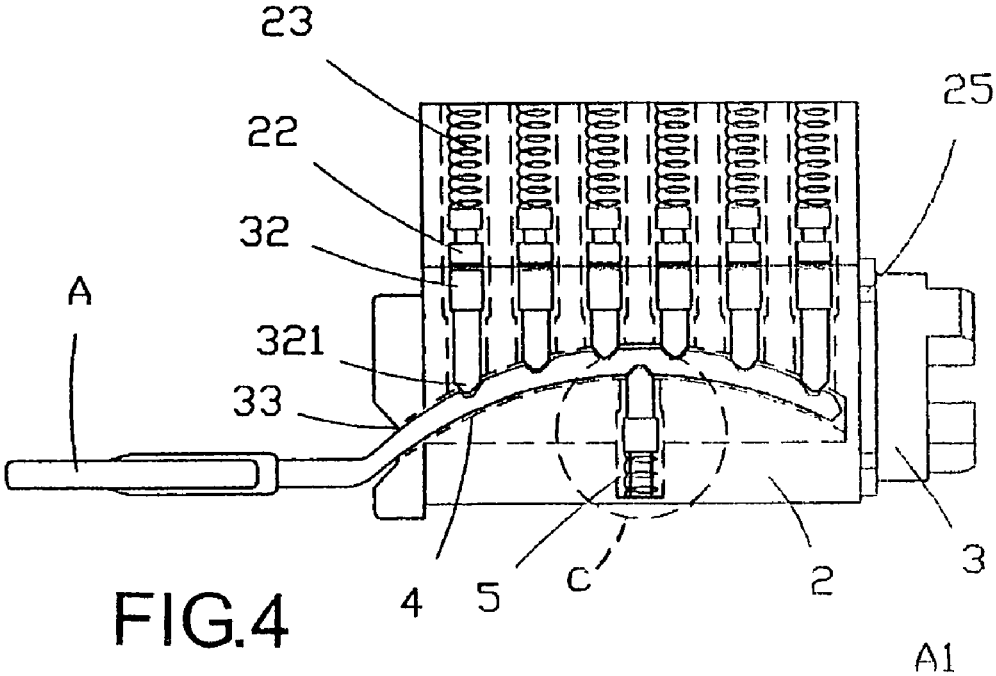
FIG. 4 shows a schematic view of the profile after inserting an opening key (horizontal direction) of the present invention.
Figure 4A:
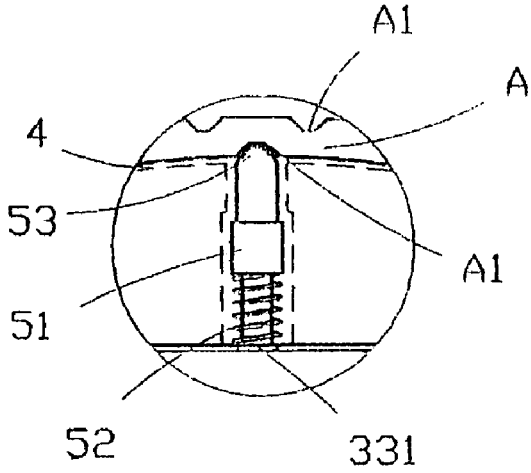
FIG. 4A shows an enlargement of area C of FIG. 4.

Accordingly, to rotate the plug 3 inside the shell 2 to open a lock, the key A with corresponding curvature (as shown in FIG. 4 and FIG. 4A) is required to have notches A1 corresponding to the lower pins 32 and the cone apex 53 of the control valve 5, in order to simultaneously press the upper pins 22 to separate from the lower pin chamber 31, and insert into the upper chamber 21, such that a clean-out smooth surface is formed between the shell 2 and the plug 3, and the plug can be rotated to open the lock. If an opening key does not have corresponding curvature, the plug 3 inside the shell 2 cannot be rotated, and remains restrained by the wall edge of the cone apexes 321 of the lower pins extending through the concave surface 41, on the other hand, as the control vale 5 cannot be simultaneously pressed, the lock is still cannot be opened, even using a flexible and bendable tool such as an iron wire.

Figure 6A:
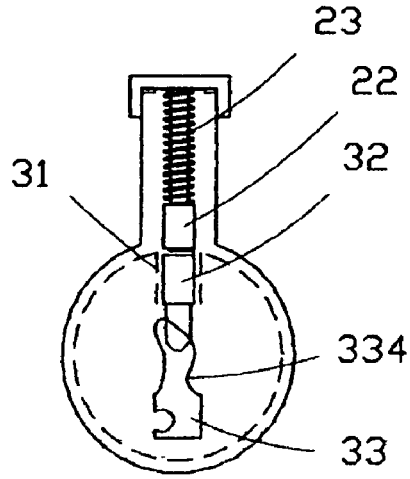
FIG. 6A shows a side view from the direction of a key slot in FIG. 6 of the present invention.

Referring to FIG. 6 and FIG. 6A, it shows a schematic view of the profile of implementation using another form of an opening key B (vertical direction). The another form of an opening key B is also required to have curvature corresponding to the passage 4 (referring to FIG. 4 and FIG. 4A), and notches B1 corresponding to the lower pins 32 and the cone apex of the control valve (not shown), in order to simultaneously press the upper pins 22 to separate from the lower pin chamber 31 to insert into the upper chamber 21, such that a clean-out smooth surface is formed between the shell 2 and the plug 3, and the plug can be rotated to open the lock.

Figure 7:
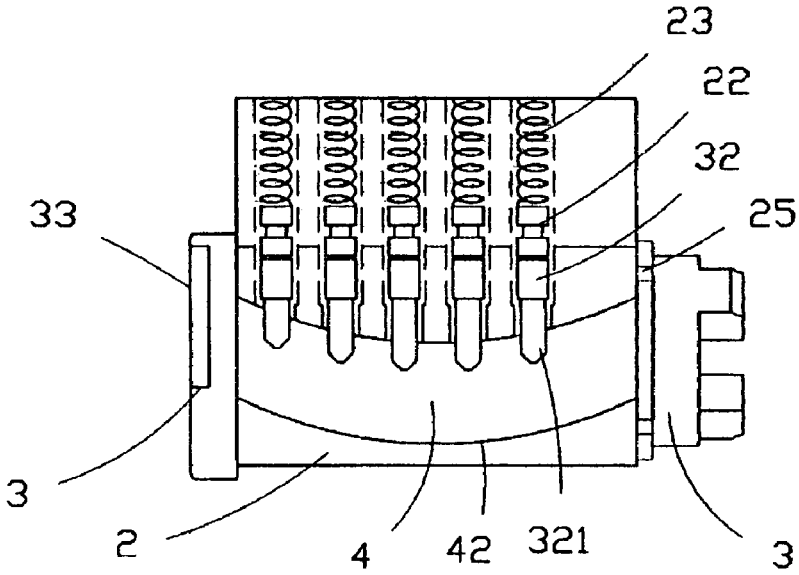
FIG. 7 shows a schematic view of the profile of implementation with another orientation of passage curvature (opened vertically) of the present invention.

Referring to FIG. 5 and FIG. 7, it shows a schematic view of the profile of implementation of another orientation of passage curvature of the passage 4. A concave surface 42 can be formed by bending backward the passage 4 to offset the center of the key slot 33, and the cone apexes 321 of a plurality of lower pins 32 can be extended out of the lower pin chamber 31 to align in the wall edge of the key slot 33. Lengths of the lower pins 32 are gradually increased toward a center of the concave surface 42 in an orderly fashion, and a control valve (not shown in the figure) is also located at the center of a side of the convex surface 42 inside the key slot 33 opposite the lower pins 32, such that an intrusion prevention status is formed between the convex surface 42 and the control valve.

Moreover, restriction pins 332 (as shown in FIG. 3A) or grooves 334 (as shown in FIG. 6A) are located at two sides of the cone apexes 321 of the lower pins 32 extended out of the key slot 33, to prevent objects such as iron wires from pressing the cone apexes 321 of the lower pins 32, and opening a lock maliciously.

Comparing with the conventional technique, the present invention of a burglarproof lock core structure has the following characteristics:

- A key with curvature corresponding to the passage and notches corresponding to the cone apexes is required to open a lock, and thus is extremely secured.
- The present invention can effectively prevent flexible tools such as iron wires from intrusion.
- The lock core structure can protect a key from damage upon usage.
- The present invention has a value of industrial application.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A burglarproof lock core structure comprising:

a) a shell having upper pin chambers;

b) a plug inserted into the shell and having:

i) lower pin chambers communicating with the upper pin chambers;

ii) a key slot located on an end thereof;

iii) a passage curved between its upper and lower portions along a longitudinal plane and located on an interior thereof and communicating with the key slot and the lower pin chambers; and iv) a control valve located in the curved passage opposite the lower pin chambers and having an apex;

c) a plurality of lower pins located in the lower pin chamber, the plurality of lower pins have lower pin apexes extending into the curved passage a predetermined distance;

d) a plurality of springs located in the upper pin chambers;

e) a plurality of upper pins located between the plurality of lower pins and the plurality of springs, the plurality of upper pins being movable between locked and unlocked positions; and f) an opening key having a curved portion matching the curved passage and being removably inserted therein and a plurality of notches located on the curved portion and selectively aligning with the plurality of lower apexes and the apex of the control valve, wherein when the opening key is inserted into the curved passage the plurality of notches positioning the plurality of lower pins in predetermined positions and moving the plurality of upper pins to the unlocked position allowing the plug to be rotated in the shell, and when the opening key is removed from the curved passage the plurality of springs press the plurality of upper pins to the locked position preventing the plug from being rotated in the shell, wherein the lower pin apexes form a curved line along a longitudinal plane when the opening key is removed from the curved passage.

2. The burglarproof lock core structure according to claim 1, wherein the control valve includes a control pin and a spring, the apex of the control valve being located on an end of the control pin.

3. The burglarproof lock core structure according to claim 1, wherein the control valve is located in a middle of the curved passage between two opposing ends thereof.

* * * * *